US006209866B1

(12) United States Patent
Hosking et al.

(10) Patent No.: US 6,209,866 B1
(45) Date of Patent: Apr. 3, 2001

(54) DOCUMENT ALIGNMENT SYSTEM

(75) Inventors: Steven Michael Hosking, Hampshire; Martin Christopher Knapp, Hants, both of (GB)

(73) Assignee: De la Rue International Limited, Basingstoke (GB)

( * ) Notice: Subject to any disclaimer, the term of this patent is extended or adjusted under 35 U.S.C. 154(b) by 0 days.

(21) Appl. No.: 09/230,486

(22) PCT Filed: Aug. 20, 1998

(86) PCT No.: PCT/GB98/02509

§ 371 Date: Feb. 16, 1999

§ 102(e) Date: Feb. 16, 1999

(30) Foreign Application Priority Data

Aug. 22, 1997 (GB) ..... 9717938

(51) Int. Cl.[7] ..... B65H 7/02; B65H 9/04

(52) U.S. Cl. ..... 271/228; 271/227; 271/253; 271/255

(58) Field of Search ..... 271/226, 227, 271/228, 253, 255

(56) References Cited

U.S. PATENT DOCUMENTS 3,759,382 * 9/1973 Walkley et al. ..... 209/111.7 X
5,219,159 6/1993 Malachowski et al. .
5,273,274 12/1993 Thomson et al. .
5,577,719 11/1996 Nicoll .

FOREIGN PATENT DOCUMENTS 25 09 276 A1 9/1976 (DE) .
40 40 830 A1 7/1992 (DE) .
0 577 928 A1 1/1994 (EP) .
0 736 473 A2 10/1996 (EP) .
404323135 * 11/1992 (JP) ..... 271/228

* cited by examiner

*Primary Examiner*—Christopher P. Ellis
*Assistant Examiner*—Kenneth W Bower
(74) *Attorney, Agent, or Firm*—Oliff & Berridge, PLC

(57) ABSTRACT

A document alignment system comprises a feed system (6), defining an elongate path, for feeding documents along the path. The feed system is adjustable to vary the orientation of the elongate path in a lateral plain so as to cause a document to undergo a corresponding lateral shift as it is moved along the path. A detector (25,26) detects the lateral position of a document upstream of the elongate path. A control system (70,17,17') is responsive to the detector (25,26) to adjust the feed system (6) so that the document undergoes a desired amount of lateral movement as it is moved along the elongate path.

17 Claims, 9 Drawing Sheets

14a
14b
15
15
17
8
8
17
11
9
6
7
11
11
11
9
9
11
11
10
10
10
10
10
11
11
11

DOCUMENT ALIGNMENT SYSTEM

The invention relates to a document alignment system, for example for aligning documents of value such as banknotes.

In conventional document processing systems, documents are transported along a path so that they can be inspected for authenticity, value or the like and then directed to a suitable destination. Examples of such equipment include banknote sorting equipment, letter sorting equipment and the like. One of the problems with such equipment is that the documents must be transported in accurate alignment so that information can be detected from them. In many such types of equipment, the documents are supplied only roughly organised into alignment and this reduces the efficiency of the apparatus. In this context, alignment refers to the lateral position of a document relative to the transport direction and should be contrasted with skew which represents a degree of twist imparted to the document.

U.S. Pat. No. 5,577,719 describes a document alignment system in which a document is supplied to an alignment position in which a set of transversely arranged rolls can be selectively energised to move the document while it is held in the alignment position. Thereafter, the document feed is reactivated and the aligned document fed onto the next stage in the process. The problem with this approach is that the document feed has to be stopped while alignment is carried out.

EP-A-0577928 illustrates a document transport system including an alignment roller mounted on a shaft which can be pivoted through a small angle depending upon the degree of realignment required. This system can only achieve minimal realignment.

U.S. Pat. No. 5,219,159 describes a sheet de-skew and registration device in an electrophotographic printing machine. A sheet is de-skewed by driving its leading edge into a nip between two pairs of stalled or stationary rollers and then, whilst transporting the sheet between these rollers, the roller pairs and sheet are moved laterally to a required position set by detection of the edge of the sheet. The problem with this system is the need to stop the rollers to achieve part of the realignment process which restricts the speed at which the machine can operate.

DE-A-2509276 describes an alignment mechanism for transporting overlapped sheets. The sheets are transported on a series of parallel belts which are angled to the nominal sheet feed direction in order to urge one edge of the sheets towards a transport side guide. The angle of these belts is adjusted manually prior to operation of the system. In this case, it is essential that all sheets fed to the alignment mechanism have a known orientation which means that this system is not suited to many situations in which the alignment of documents is not known.

In accordance with one aspect of the present invention, a document alignment system comprises a feed system, defining an elongate path, for feeding documents along the path, the feed system being adjustable to vary the orientation of the elongate path in a lateral plane so as to cause a document to undergo a corresponding lateral shift as it is moved along the path; a detector for detecting the lateral position of a document upstream of the elongate path; and a control system responsive to the detector to adjust the feed system so that the document undergoes a desired amount of lateral movement as it is moved along the elongate path.

In accordance with a second aspect of the present invention, a method of aligning documents comprises supplying documents to a document alignment system according to the first aspect of the invention; detecting the lateral position of each document; and adjusting the feed system to cause the document to undergo a desired amount of lateral movement as the document moves along the elongate path.

This invention overcomes a number of different problems with the prior art set out above. Firstly, rather than changing the lateral position of a feed nip, the orientation of the elongate path itself is adjusted and this allows much more accurate control of the feeding of sheets to be achieved which is particularly important in the case of old sheets such as used currency and for achieving high speed operation as found in banknote dispensing and sorting apparatus.

In addition, the system enables automatic alignment of documents to be achieved by detecting the lateral position of the document upstream of the elongate path and adjusting the feed system accordingly. Typically, that adjustment will be to centralize the document but in other cases the document could be aligned with any datum position.

A further important advantage of this invention is that it enables a document to be aligned relative to any datum i.e. a "virtual datum" system. This should be contrasted with known alignment systems in which documents are aligned against a fixed datum wall.

This alignment is achieved by the control system adjusting the feed system to the appropriate lateral position. Conveniently, this is achieved by a control system including a detector which can detect the lateral position of the feed system. The control system detector could simply detect a part of the feed system but preferably the feed system includes an indicator which moves laterally with the feed system and is detected by the detector of the control system.

The use of a special indicator enhances the accuracy of the operation of the control system and allows the indicator to have a special form for example a form which varies in the lateral direction so its direction of displacement can be uniquely determined. In the preferred example, this indicator or flag has a wedge shape.

The control system could include a moveable detector which is moved in response to the desired amount of lateral movement of the document, the control system always centering the indicator with the detector (or positioning it within a predetermined distance of the detector). More conveniently, however, the control system detector is fixed and the control system adjusts the position of the feed system until the relative locations of the indicator and control system detector are such that a document will undergo the desired amount of lateral movement.

In one implementation, the feed system can comprise a set of rollers spaced apart along the elongate path, a number, typically all, of the rollers being laterally adjustable. However, in the preferred arrangement, the feed system comprises at least one endless belt. This has the advantage over the use of rollers in that it is simpler in construction and requires less motive power to adjust the feed system.

The control system may be arranged to adjust the position of the endless belt(s) at a location adjacent a downstream end of the elongate path, a location adjacent an upstream end of the elongate path, or at both locations. In the latter event, it is then possible also to de-skew the document.

In some cases, the feed system will define just a lower surface of the elongate path but in the preferred arrangement, the feed system comprises a plurality of endless belts arranged in upper and lower laterally spaced sets relative to the elongate path, each belt of the upper set being laterally offset from adjacent belts of the lower set. This allows more complete control of the passage of documents to be achieved while laterally spacing the belts apart has been found to improve overall operation of the system.

Typically, the feed system comprises a pulley mounted on a shaft, the pulley being coupled to the control system for lateral displacement. The pulley could form part of the feed system defining the elongate path (i.e. a roller as discussed above) or an endless belt could be entrained around the pulley.

The pulley could be slidably mounted on a shaft for lateral movement but preferably is mounted for lateral movement with the shaft. This enables the lateral movement to be achieved by moving the shaft from a position remote from the pulley. Typically, the pulley will be nonrotatably mounted to the shaft so that it can be easily driven from the shaft although this is not essential. For example, the pulley could be rotatably mounted to the shaft and then driven from a separate drive roller which engages the pulley.

In some cases a further detector could be provided downstream of the feed system so as to check whether or not the documents are now aligned.

As mentioned previously, the document alignment system can be used in a wide variety of applications including document processing equipment such as banknote dispensers, acceptors, sorters and recyclers. In these applications, the alignment system will normally be provided upstream of the remainder of the document processing, however, it is envisaged the system will be of use at intermediate stations in longer document transporting systems.

Examples of banknote alignment systems according to the present invention will now be described with reference to the accompanying drawings, in which.

Figure 4:
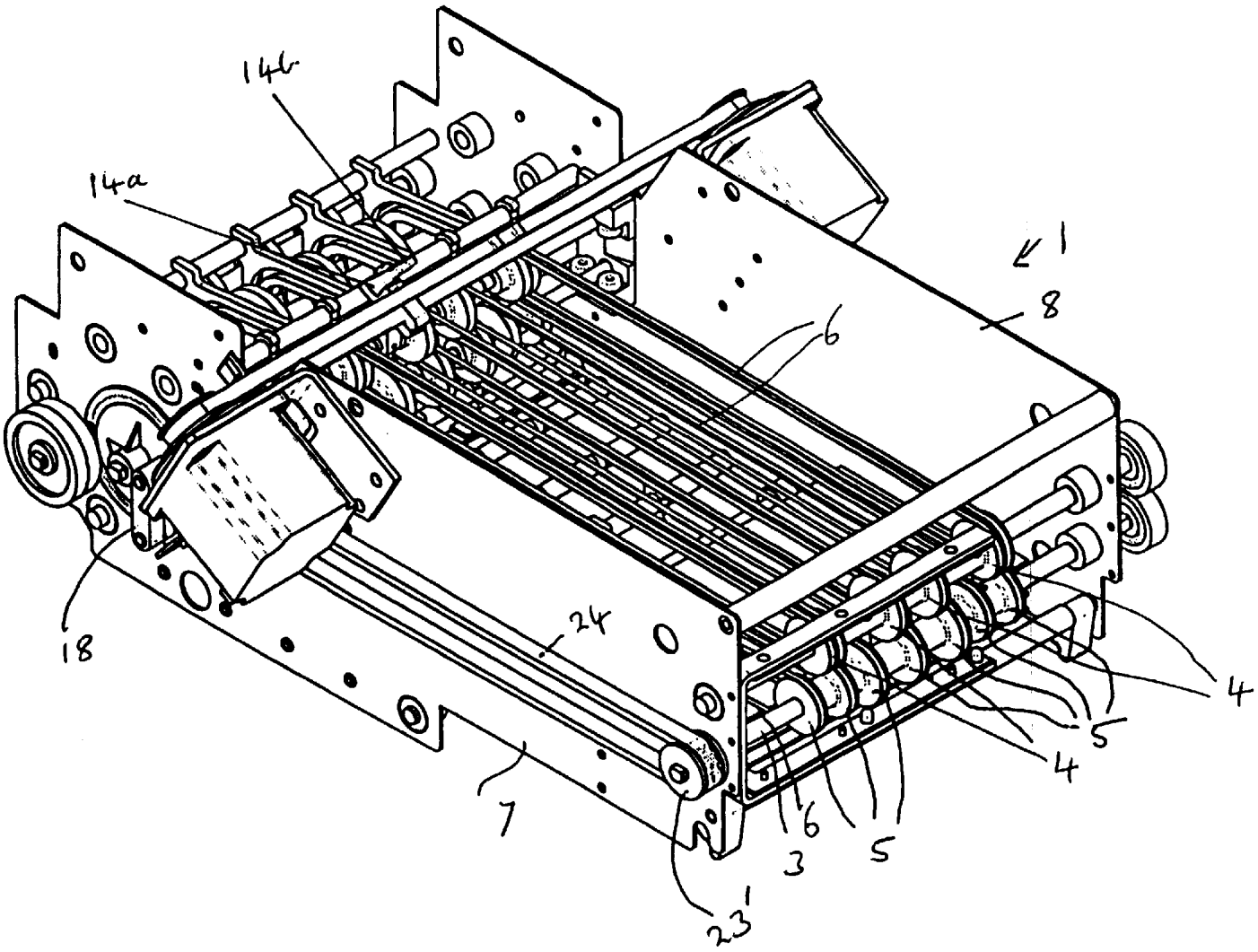
FIG. 4 is a view similar to FIG. 2 but with some parts omitted.

The banknote alignment system shown in the drawings is in the form of a module 1 having a pair of side plates 7,8 held spaced apart by a set of spacers 9. A set of pulleys 4 are mounted non-rotatably to a shaft 2 journalled between the side plates 7,8. A second set of pulleys 5 offset relative to the pulleys 4 are non-rotatably mounted on a shaft 3 journalled between the side plates 7,8 (FIG. 4). The sets of rollers 4,5 define an inlet to the module 1 for documents. The ends of the shafts 2,3 where they project through the plate 8 carry respective ones of a pair of intermeshing gears 40,41 fixed, non-rotatably, to the shafts 2,3. The gear 41 meshes with an earlier stage of the sheet transport mechanism located at 200. Thus, the motor used to drive the sheet transport mechanism 200 is also used to drive the shafts 2,3.

Figure 3:
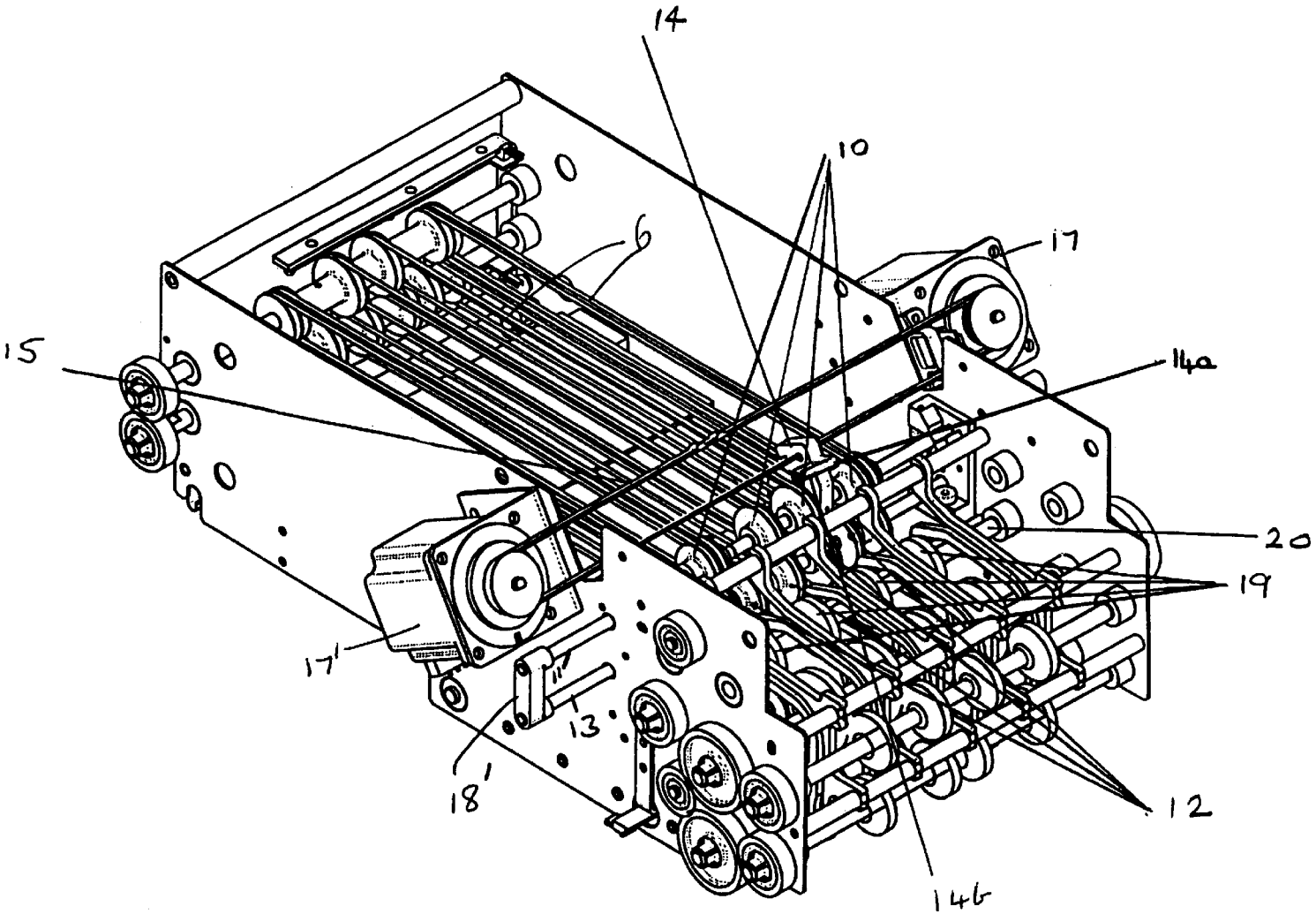
FIG. 3 is a view similar to FIG. 1 but with some parts omitted.

Towards the other end of the module 1 are positioned a second pair of upper and lower shafts 11,13, each carrying a respective set of pulleys 10,12 (FIG. 3). Pulleys 12 are offset from pulleys 10 in a manner matching the arrangement between pulleys 5 and 4. The shafts 11,13 are mounted in bearings (not shown) in each of the side plates 7,8 and attached to each other by respective link plates 18,18' at each end in such a way that allows them to be moved at right angles to the side plates so as to traverse the pulleys 10,12 maintained in their relative offset positions, to and fro between the side plates 7,8.

A set of suitably profiled belts (for example "O" ring or "T" section) 6 are entrained around respective pairs of the pulleys 4,10 and 5,12. The lower section of each upper belt 6 and the upper section of each lower belt 6 define a document transport path from the inlet to the module 1 towards the outlet.

Figure 5:
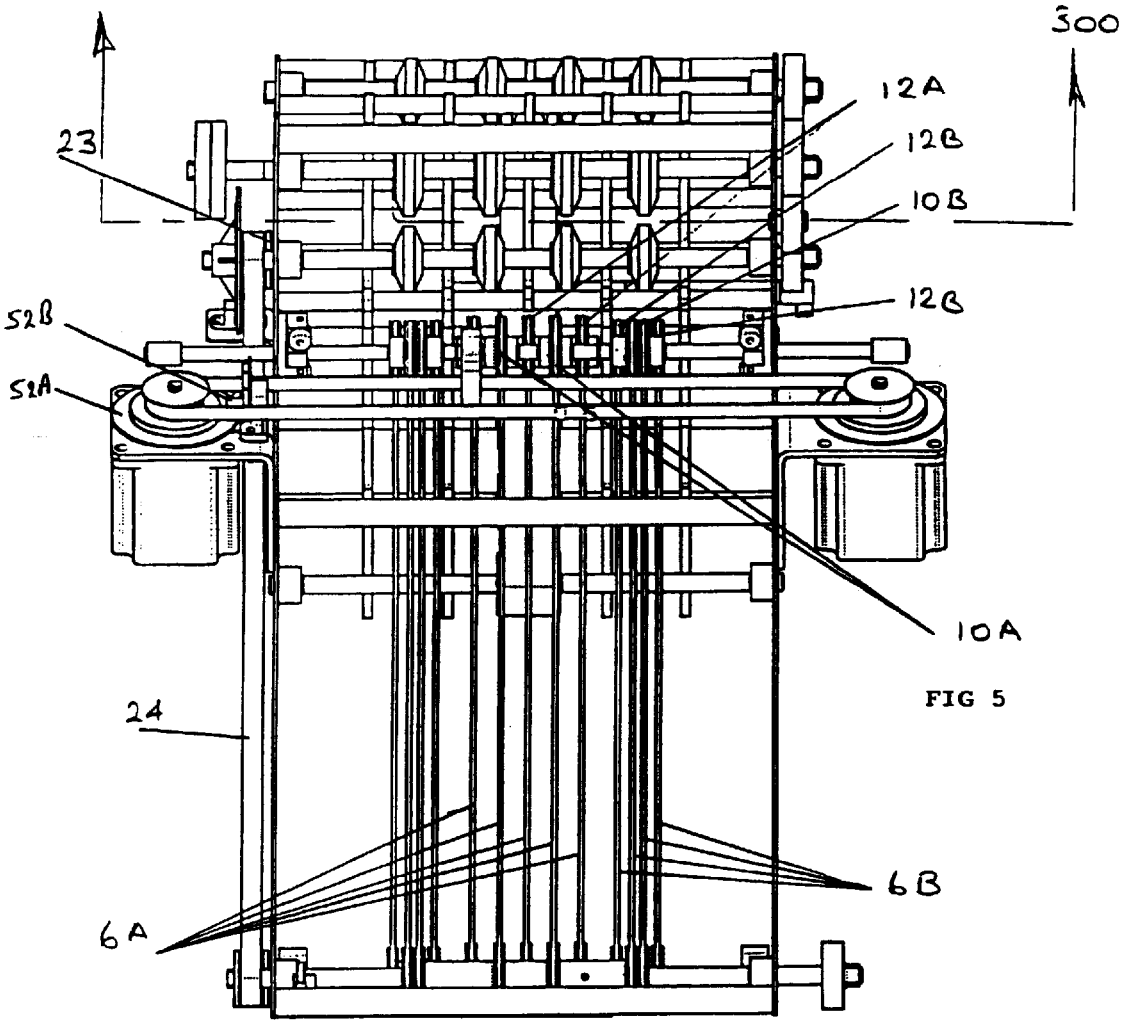
FIG. 5 is a plan of FIG. 1 with some parts, including the flag, omitted.
Figure 6:
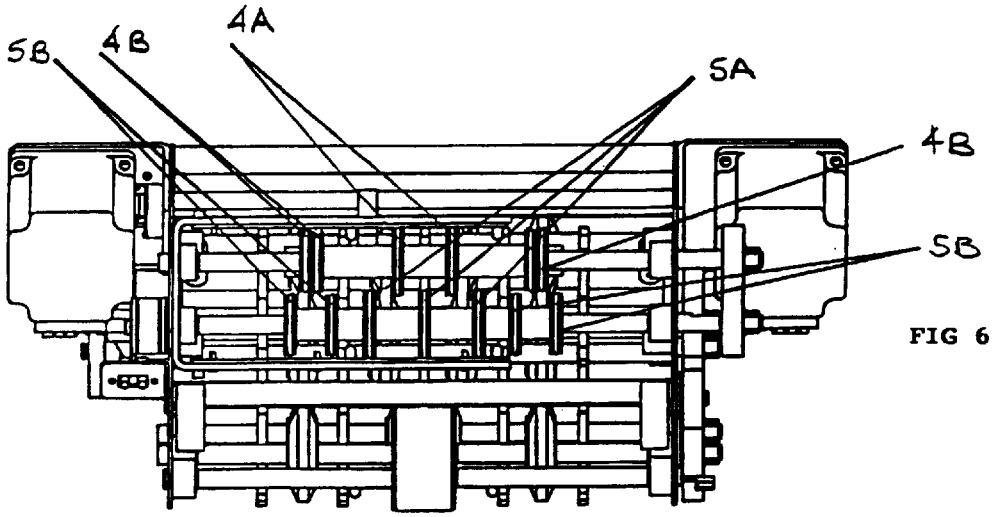
FIG. 6 is an end view of FIG. 1.

In practice, the diameters of the pulleys 4,5 (and similarly pulleys 10,12) vary depending upon their lateral position. This is shown most clearly in FIGS. 5 and 6 where it will be seen that the pulleys 4 comprise a pair of inner, larger diameter pulleys 4A and laterally outer, smaller diameter pulleys 4B. Similarly, the pulleys 5 comprise a set of three inner, larger diameter pulleys 5A and four outer, smaller diameter pulleys 5B. As can be seen in FIG. 5, the pulleys 10 comprise a pair of inner, larger diameter pulleys 10A and a set of outer, smaller diameter pulleys 10B. The pulleys 12 comprise a set of three inner, larger diameter pulleys 12A and a set of outer, smaller diameter pulleys 12B. The result of using these different diameter pulleys is that sheets assume a corrugated cross-sectional shape as they are transported. Furthermore, pulleys 4B and 5B (and similarly 10B and 12B) are of a diameter which provides a clearance between the nominal flat sheet transporting position and the upper surface of the lower transporting belt 6B between rollers 5B and 12B and the lower surface of the upper transporting belt 6B between the rollers 4B and lOB. Belts 6B, therefore, provide moving guides to support the outer ends of sheets being transported through the system.

Figure 1:
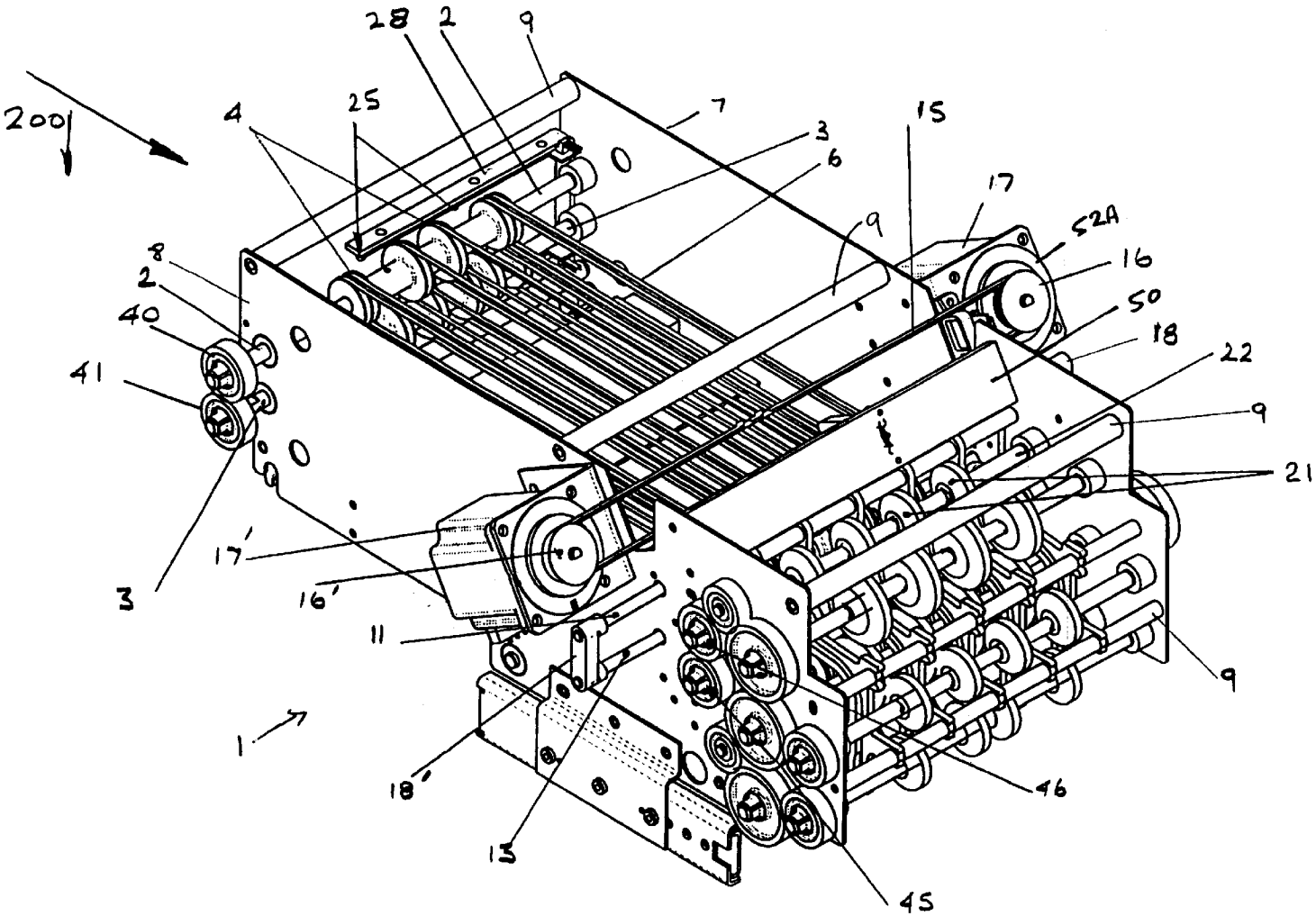
FIG. 1 is a schematic, perspective view of a first bank note alignment system from above and one side.

A further pair of shafts 20,22 are journalled between the side plates 7,8 and carry respective sets of pulleys 19,21 non-rotatably mounted to them (FIGS. 1 and 3). These pulleys are aligned and the nips between the pulleys 19,21 are aligned across the nominal sheet transport path defined by the belts 6 at the outlet end of the feed path. The shafts 20,22 protrude through the side plate 8 where intermeshing gears 45,46 respectively are non-rotatably mounted to them.

The shaft 20 also protrudes out from the side plate 7 and carries non-rotatably a pulley 23 about which is entrained a toothed drive belt 24 (FIG. 4). The belt 24 is also entrained about a pulley 23' non-rotatably mounted to the shaft 3 where it protrudes through the side plate 7 so that the shaft 20 is driven from the shaft 3.

As a result, the pulleys 4 rotate anti-clockwise looking from the side plate 8 towards the side plate 7 and the pulleys 5 rotate clockwise. The pulleys 21 rotate anti-clockwise and the pulleys 19 clockwise.

As will be appreciated from the description above, the lateral position of the pulleys 10,12 is adjustable by suitably moving the shafts 11,13. In this example, movement is obtained by suitably controlling a pair of stepping motors 17,17' attached to the side plates 7,8 respectively. Each stepping motor 17,17' is connected to a respective drive pulley 16,16' around which is entrained a belt 15. The belt 15 is secured to a bracket 14 (FIG. 3) which is also secured to the shaft 11. Thus, by suitably operating the stepping motors 17,17', the belt 15 is moved to and fro between the side plates 7,8 causing corresponding movement of the shafts 11,13.

A U-shaped optical sensor 51 is mounted to a support So between the two side plates 7,8. The U-shaped sensor 51 is designed to determine when the displaceable carriage, formed by shafts 11,13, is in a central position, to the right of the central position or to the left of the central position with respect to the two side plates 7,8. This is achieved by having a flag 14*a* mounted on the bracket 14 (FIG. 3), the flag 14*a* having a lateral, wedge shaped extension 14*b*. The U-shaped sensor 51 and the flag 14*a* are positioned such that when the displaceable carriage is in the central position, the extension 14*b* of the flag 14*a* (FIG. 3) will be located between the arms of the U-shaped sensor 51 at the approximate central position. This will be used by the microprocessor 70 (discussed below) to determine when the carriage is in the central position. when the flag 14*a* increasingly obscures the U-shaped sensor 51 the displaceable carriage will be positioned away from the central position towards the side plate 7 and when the flag 14*a* obscures the U-shaped sensor 51 less the displaceable carriage will be positioned away from the central position towards the side plate 8. This provides feedback to the microprocessor 70 enabling it to confirm correct operation of the motors 17,17'.

The amount of displacement of the displaceable carriage is then monitored by a tachometer 52, which is provided on the motor 17. The tachometer 52 consists of a timing disk 52A and a quadrature optical sensor 52B (FIG. 5) which allows the position of the motor 17 to be monitored. A signal representative of the motor position is fed to the microprocessor 70 which then uses this information to track the motion of the displaceable carriage from when it was last in the central position. This allows the microprocessor 70 to determine the current displacement of the carriage from the central position.

A number of sensors 25,26 are supported above and below the feed path respectively on a U-shaped bracket 28 attached to the side plate 7. The sensors 25 and 26 are to monitor the progress of the notes through the centraliser mechanism 1. Used in conjunction with a shaft encoder (not shown) and knowing the mechanical geometry they can be used to track where the notes are within the transport at any time. This is very important as the displaceable carriage, formed by shafts 11,13 should not be displaced in a lateral direction whilst a note is in the gap between shafts 11,13 and 20,22 as the note is pinched by the pulleys on each of these shafts and lateral movement during this transition would tear the note. The purpose of the sensors 25,26 is to allow the microprocessor 70 (discussed below) to monitor the position of the notes as they pass through the centraliser and determine the time when the carriage may be displaced. In the case of a single note passing through the system, this may not be crucial, but in the case where a stream of notes is to be centralised, this information is critical to the successful operation of the unit. Two laterally spaced sensor pairs 25,26 are used in this case to allow the skew of the note to be measured and allowance made for its increased effective length as a result of any skew.

Figure 2:
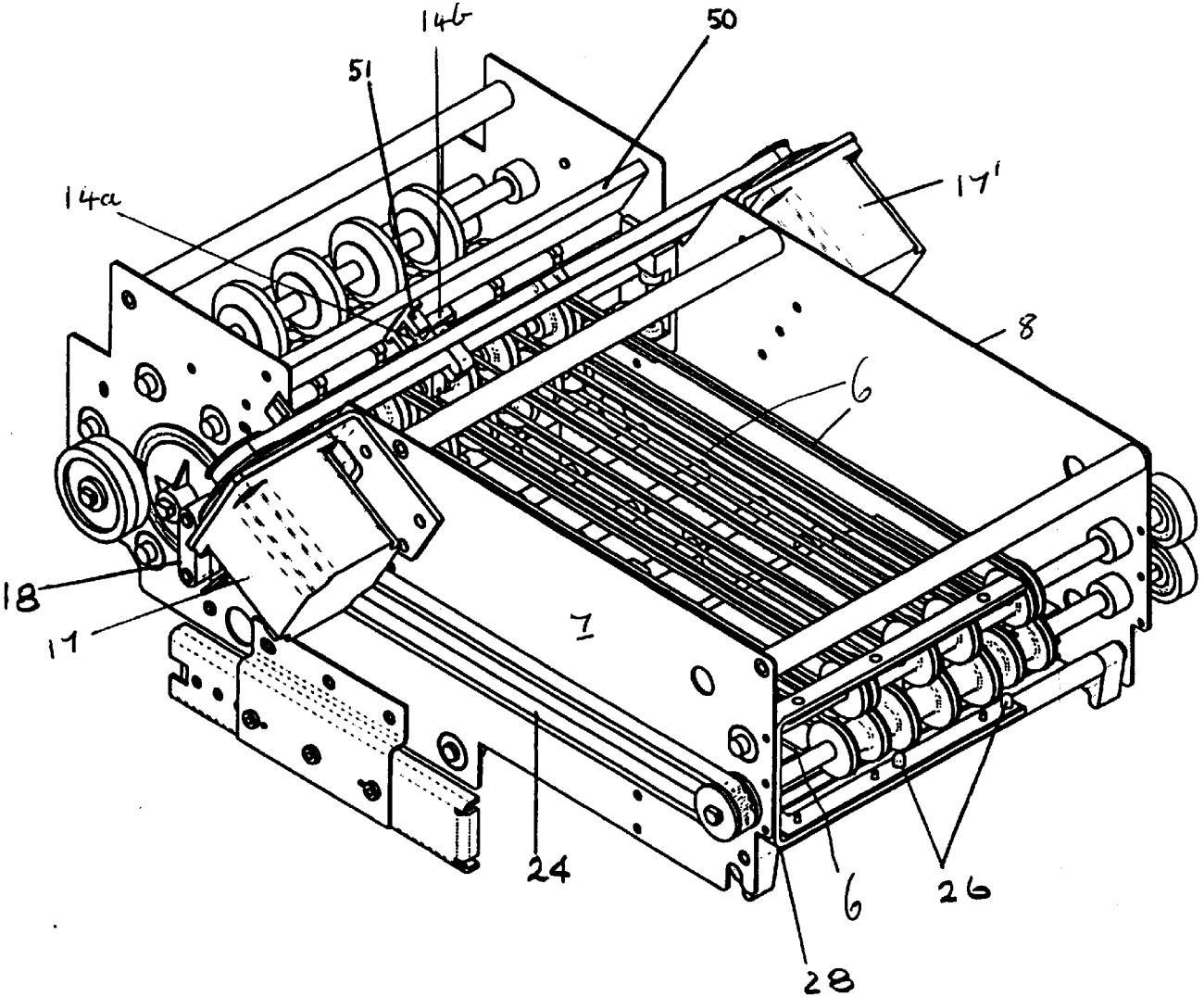
FIG. 2 is a schematic, perspective view of FIG. 1 from above and the other side.
Figure 7:
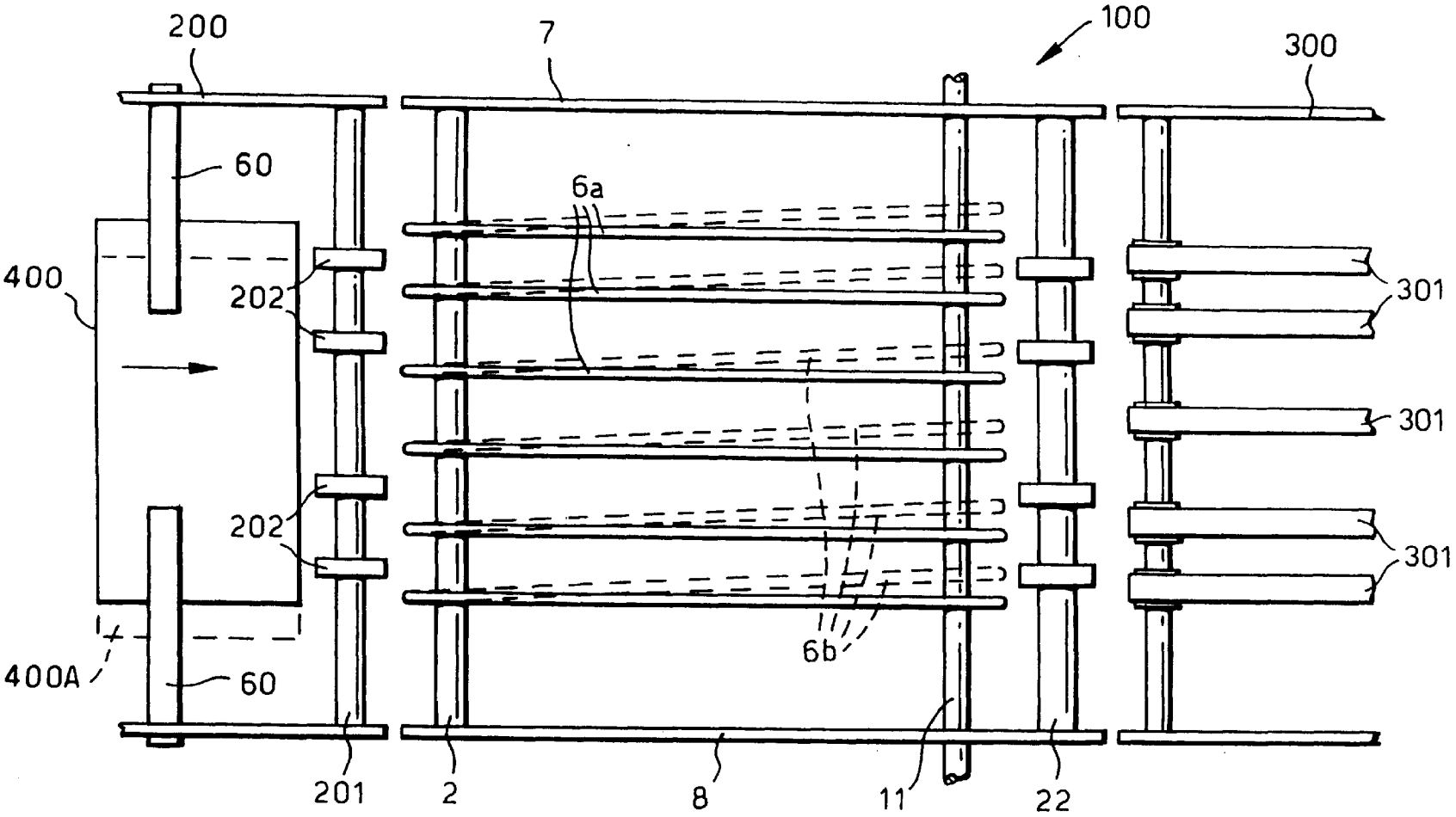
FIG. 7 is a schematic plan of the main components of the apparatus shown in FIG. 1.

As can be seen in FIG. 7, the module 1 is located between a sheet transport system 200 for transporting sheets 400 one by one to the module 1 and a downstream sheet transport 300 for transporting the sheet exiting the module 1 towards its eventual destination. A detector arrangement 60 which may be of any known type is provided for determining the position of moving sheets as they reach the module 1, the sheets being transported to the pulleys 4,5 by rotation of a shaft 201 carrying pulleys 202. The detector arrangement 60 determines the lateral offset of an incoming sheet 400 which may, for example, be accurately aligned as shown in solid lines in FIG. 2 or laterally offset to a position 400A as shown in dashed lines. The detector arrangement 60 is connected to a microprocessor 70 (FIG. 8) which generates an output signal on a line 71 which is fed to a motor control circuit 72 which controls the stepper motors 17,17'.

The detector arrangement 60 could be implemented in a number of different ways. A typical method would be a linear array of light emitting devices, and photoreceivers (photodiodes or photoresistors), placed either side of the note path, such that the note will break the beams between the devices. If these devices are placed on say a 1 mm pitch then the lateral position of the note can be determined quite accurately by monitoring the number of devices that are blocked on each side as the note passes.

An alternative approach is to use two rectangular large area photodiodes, each illuminated by a similarly shaped light source, these being placed as shown in FIG. 7. In this instance, as the note passes between the emitter and sensor on each side, it will partially block the light passing between them, the proportion of light being blocked giving a measurement of the amount of note between them. If the two sensors are similar and if the note is centrally placed then the proportion blocked on each side will be the same, if the note is offset then the proportion will be different on each side, the amount of difference giving a measurement of the offset of the note.

By allowing both ends of the belts to be laterally shifted, skew induced in the sheets during alignment correction can also be corrected. In this modification (which is described later), the detector 60 would also be used to determine the extent of skew and further drive means similar to that shown to drive shafts 11,13 will be needed to drive the shafts 2,3.

In a further possibility, a sensor arrangement already present, for example for use in pattern detection, could also be utilised to determine the location of the edges of notes.

Documents fed through the module 1 are supplied to friction drive belts 301 of the downstream transport 300.

In operation, a sheet 400 is normally transported towards its eventual destination in a manner in which the leading edge of the sheet is, within acceptable limits, at right angles to the direction in which the sheet is being transported. In addition, the sheet is transported, within acceptable limits, along a predetermined path in which the sheet is positioned such that its transport direction centre line is on the centre line of the transporting media arrangement. In this normal arrangement, the module 1 is operated with the pulleys 10,12 located so that the belts 6 run normally parallel to the side plates 7,8 as shown at 6*a* in FIG. 7.

In the event that a sheet 400 being transported is not correctly positioned laterally as shown at 400A, then this will be sensed by the detector arrangement 60. The microprocessor 70 computes from the amount of displacement how much the sheet must be displaced laterally to compensate and bring it back to a centralised position.

Once this has been calculated, the microprocessor 70 uses the position information determined from the sensor 51 and the tachometers 52,52' to determine the current position of the displaceable carriage. The microprocessor 70 then calculates the distance between the current carriage position and the carriage position required to centralise the note and uses this information to control the motors 17,17' thereby placing the displaceable carriage in the correct position. The motors are generally controlled to operate at one of three different speeds, with a slow speed being used for small displacements and a faster speed being used for larger displacements. The system preferably uses the slowest speed, wherever possible, as this results in more reliable positioning.

Once the microprocessor 70 has determined the suitable position for the displaceable carriage the microprocessor 70 outputs a suitable signal on the line 71 to the motor control circuit 72 which activates the motors 17,17' to drive the drive belt 15. In the example shown in FIG. 7, the document must be laterally offset towards the plate 7. Consequently, the shafts 11,13 are moved from the side plate 8 towards the side plate 7 so that the belts 6 take up the positions 6*b* shown in dashed lines in FIG. 7. As the sheet 400A continues to be fed into the module 1, it will be gripped between the belts 6 now located in the position 6*b* and as it is transported through the module 1, it will also be shifted laterally towards the side plate 7 so that the centre line of the sheet as it exits the module 1 is realigned with the centre line of the module.

Figure 8:
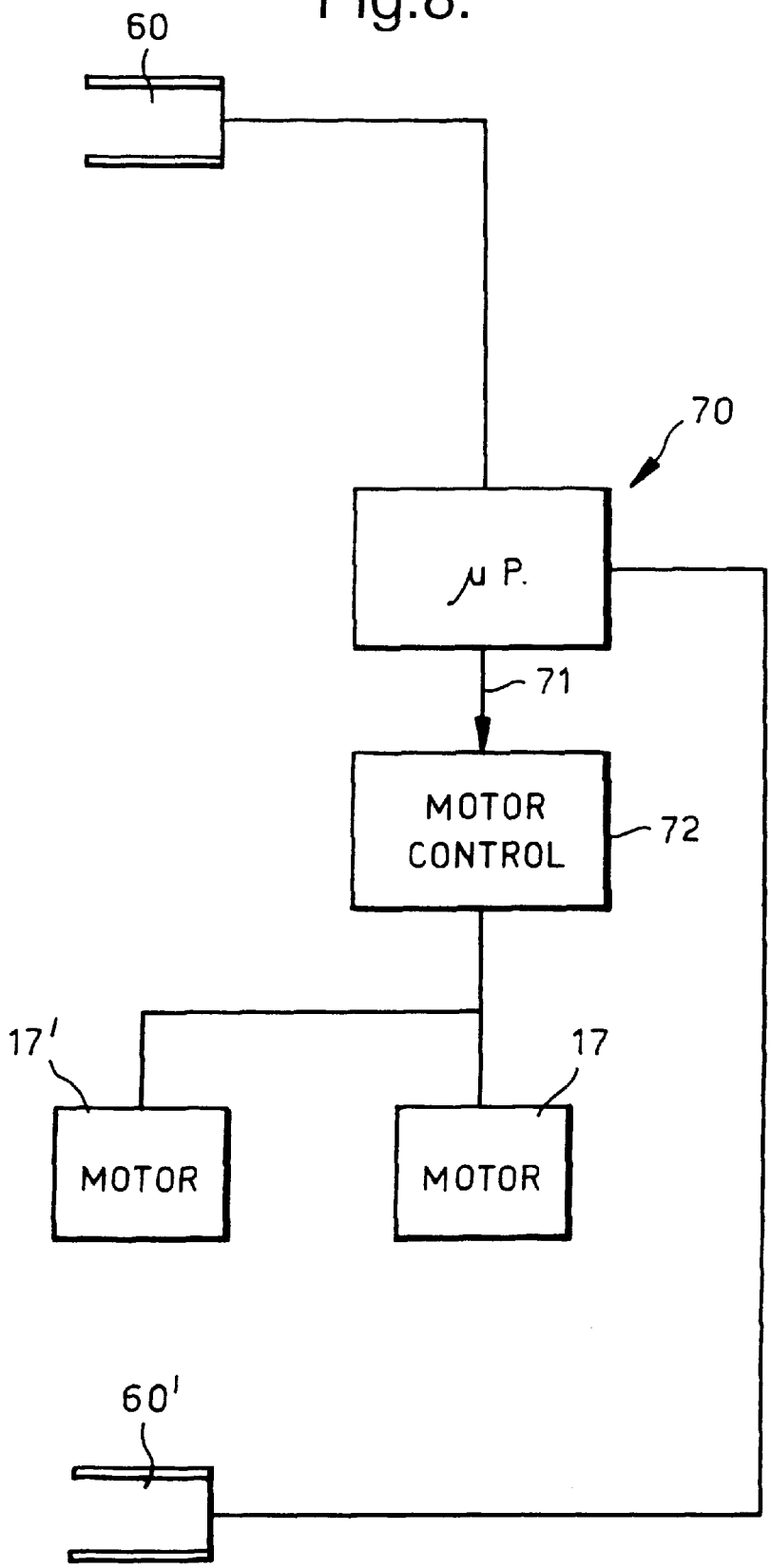
FIG. 8 is a block diagram of the control system.

As indicated in FIG. 8, an optional detector arrangement 60' could be positioned at the exit end of the module 1 to verify that the sheet has now been correctly positioned.

In alternative constructions, more than one alignment system could be used either one after the other or spaced serially at intervals along a sheet transport path.

In a further alternative construction, the self-centralising properties of the belt system can be utilised to eliminate the need for a double acting drive arrangement. Such an arrangement has cost benefits where the speed at which the sheets are transported are lower.

It should be noted that although two stepper motors 17,17' are shown in this case, a single stepper motor would be sufficient in many cases. With the use of a single motor the belt 15 could be replaced by a worm lead screw or rack and pinion drive arrangement to the moveable carriage. Two motors allows sufficient power to be obtained to achieve rapid displacement of the bracket 14. The use of two motors in parallel is possible because the rubber belt connecting the two motors is flexible.

In yet a further alternative construction the diameters of the pulleys 4B,5B,10B,12B will all be of the larger diameter of pulleys 4A,5A,10A, and 12A so as to provide the beneficial effect of corrugating the transported sheets across their full width.

Figure 9:
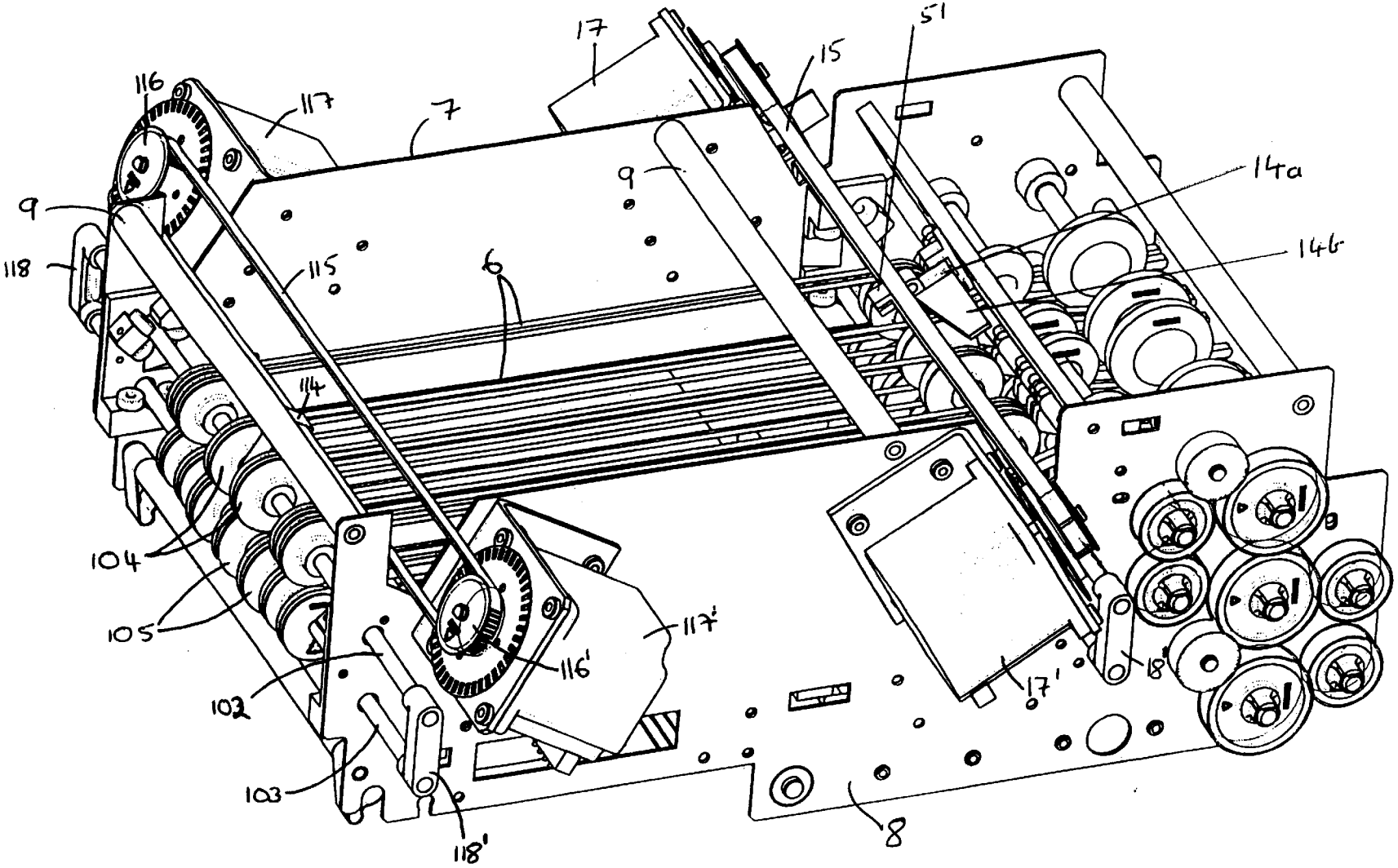
FIG. 9 is a schematic, perspective view of a second bank note alignment system from above and one side; and, FIG. 10 is a plan view of FIG. 9.
Figure 10:
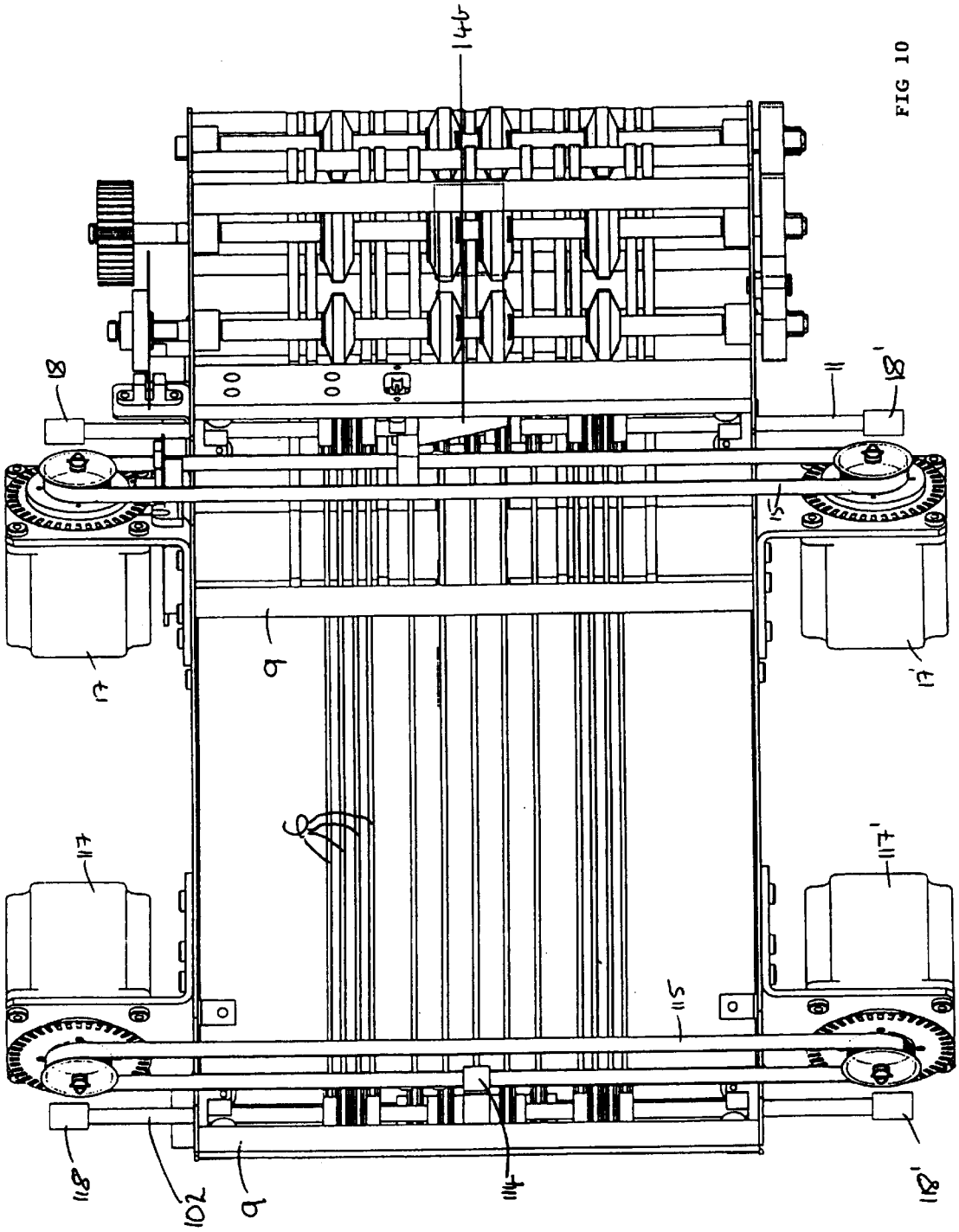

A second example of a bank note alignment system according to the present invention is shown in FIGS. 9 and 10. The apparatus is effectively the apparatus of FIG. 1 modified such that both ends of the belts 6 may be moved laterally. This is achieved by having a first set of pulleys 104 non-rotatably mounted to a shaft 102 and a second set of pulleys 105 non-rotatably mounted to a shaft 103. As with the shafts 11,13 the shafts 102, 103 are mounted in bearings (not shown) in each of the side plates 7,8. Furthermore, the shafts 102,103 are attached to each other by respective link plates 118,118' at each end in such a way that it allows them to be moved together at approximately right angles to the side plates. This allows the pulleys 104,105 to be traversed with respect to the side plates 7,8 whilst maintaining their relative offset positions.

Also provided are two stepping motors 117,117' which are attached to the side plates 7,8 respectfully. Each stepping motor 117,117' is connected to a respective drive pulley 116,116' around which is entrained a belt 115. The belt is secured to a bracket 114 which is also secured to the shaft 102. Thus, by suitably operating the stepping motors 117, 117', the belt 115 is moved to and fro between the side plates 7,8 causing corresponding movement of the shafts 102,103.

The apparatus of FIGS. 9 and 10 then operates in a similar manner to the apparatus of FIG. 1. Accordingly, when a sheet is fed into the transport system, if the sheet is not correctly positioned laterally and/or is skewed, then this is sensed by a detector arrangement (not shown). The microprocessor 70 will then compute from this the amount of displacement required. This is then achieved by moving either the shafts 11,13 or the shafts 102,103, or all four shafts 102,103,11,13.

Although not shown, it will be realised by a person skilled in the art, that a sensor arrangement, similar to the sensor 51, may be provided for the belt 115. This will allow the microprocessor 70 to determine the relative position of the pulleys 104,105 with respect to the side plates 7,8.

What is claimed is:

1. A document alignment system comprising a feed system, defining an elongate path, for feeding documents along the path, the feed system being adjustable to vary the angular orientation of the elongation path in a lateral plane so as to cause a document to undergo a corresponding lateral shift as the document is moved along the path; a detector for detecting the lateral position of a document upstream of the elongate path; and a control system responsive to the detector to adjust the feed system to vary the orientation of the elongate path so that the document undergoes a desired amount of lateral movement as the document is moved along the elongate path.

2. A document processing apparatus comprising a document alignment system according to claim 1; and a document handling system for receiving aligned documents from the document alignment system.

3. A system according to claim 1, wherein the feed system comprises at least one endless belt.

4. A system according to claim 3, wherein the control system is arranged to adjust the position of the endless belt(s) at a location adjacent a downstream end of the elongate path.

5. A system according to claim 3 wherein the control system is arranged to adjust the position of the endless belt(s) at a location adjacent an upstream end of the elongate path.

6. A system according to claim 3, wherein the control system is arranged to adjust the positions of the endless belt(s) at a location adjacent a downstream end of the elongate path and a location adjacent an upstream end of the elongate path so as to de-skew a document being transported.

7. A system according to claim 3, wherein the feed system comprises a plurality of endless belts arranged in upper and lower laterally spaced sets relative to the elongate path, each belt of the upper set being laterally offset from adjacent belts of the lower set.

8. A system according to claim 7, wherein the belts of the upper set do not overlap the belts of the lower set.

9. A system according to claim 1, wherein the feed system comprises a pulley mounted on a shaft, the pulley being coupled to the control system for lateral displacement.

10. A system according to claim 9, wherein the pulley is mounted for lateral movement with the shaft.

11. A system according to claim 10, wherein the pulley is non-rotatably mounted to the shaft.

12. A system according to claim 1, wherein the feed system includes an indicator which moves laterally with the feed system and is detected by the detector of the control system.

13. A system according to claim 11, wherein the control system adjusts the position of the feed system until the indicator is located relative to the detector of the control system such that a document will undergo the desired amount of lateral movement.

14. A system according to claim 12, wherein the indicator has a form which varies in the lateral direction so its direction of displacement can be uniquely determined.

15. A system according to claim 14, wherein the indicator is wedge shaped.

16. A method of aligning documents comprising supplying documents to a document alignment system including a feed system, defining an elongate path, for feeding documents along the path, the feed system being angularly adjustable to vary the orientation of the elongate path in a lateral plane so as to cause a document to undergo a corresponding lateral shift as the document is moved along the path, a detector for detecting the lateral position of a document upstream of the elongate path, and a control system responsive to the detector to adjust the feed system so that the document undergoes a desired amount of lateral movement as the document is moved along the elongate path; detecting the lateral position of each document; and adjusting the feed system to vary the orientation of the elongation path so as to cause the document to undergo a desired amount of lateral movement as the document moves along the elongate path.

17. A method according to claim 16, wherein the documents comprise currency that has been used.

* * * * *